US005806428A

United States Patent [19]

Koppelkamm et al.

[11] Patent Number: 5,806,428

[45] Date of Patent: Sep. 15, 1998

[54] INKING UNIT

[75] Inventors: Günter Koppelkamm, Neuensalz; Steffen Klaus, Plauen, both of Germany

[73] Assignee: MAN Roland Drückmaschinen AG, Offenbach am Main, Germany

[21] Appl. No.: 790,905

[22] Filed: Jan. 29, 1997

[30] Foreign Application Priority Data

Jan. 29, 1996 [DE] Germany ..... 196 03 024.2

[51] Int. Cl.[6] ..... B41F 31/32

[52] U.S. Cl. ..... 101/352.04

[58] Field of Search ..... 101/349.1, 350.1, 101/351.1, 351.3, 351.4, 352.01, 352.02, 352.03, 352.04, 352.05, 352.09, 247, 207–210, 148

[56] References Cited

U.S. PATENT DOCUMENTS

| | | | |
|---|---|---|---|
| 2,802,417 | 8/1957 | Forbes . | |
| 4,986,176 | 1/1991 | Ishii et al. | 101/148 |
| 5,555,806 | 9/1996 | Nawrath | 101/148 |

FOREIGN PATENT DOCUMENTS

| | | |
|---|---|---|
| 650392 | 9/1937 | Germany . |
| 3112745 | 3/1983 | Germany . |
| 3440895 | 5/1986 | Germany . |
| 3629081 | 3/1988 | Germany . |
| 300613 | 10/1954 | Switzerland . |

*Primary Examiner*—J. Reed Fisher

*Attorney, Agent, or Firm*—Cohen, Pontani, Lieberman & Pavane

[57] ABSTRACT

An inking unit for a rotary printing machine, a frame and a plurality of rollers. The plurality of rollers includes two inking rollers fixedly mounted to the frame so as to be spaced from one another, and a transfer roller mounted between the two inking rollers. Bearing levers are pivotably mounted to one of the two inking rollers. The transfer roller is mounted to the bearing levers so as to be pivotable between an operating position between the two inking rollers and a pivoted-out position away from the two inking rollers. Roller holders are provided for adjustably holding the transfer roller on the bearing levers. Finally, an apparatus is provided for compensating for the holding weight of the transfer roller and the bearing levers during pivoting.

9 Claims, 1 Drawing Sheet

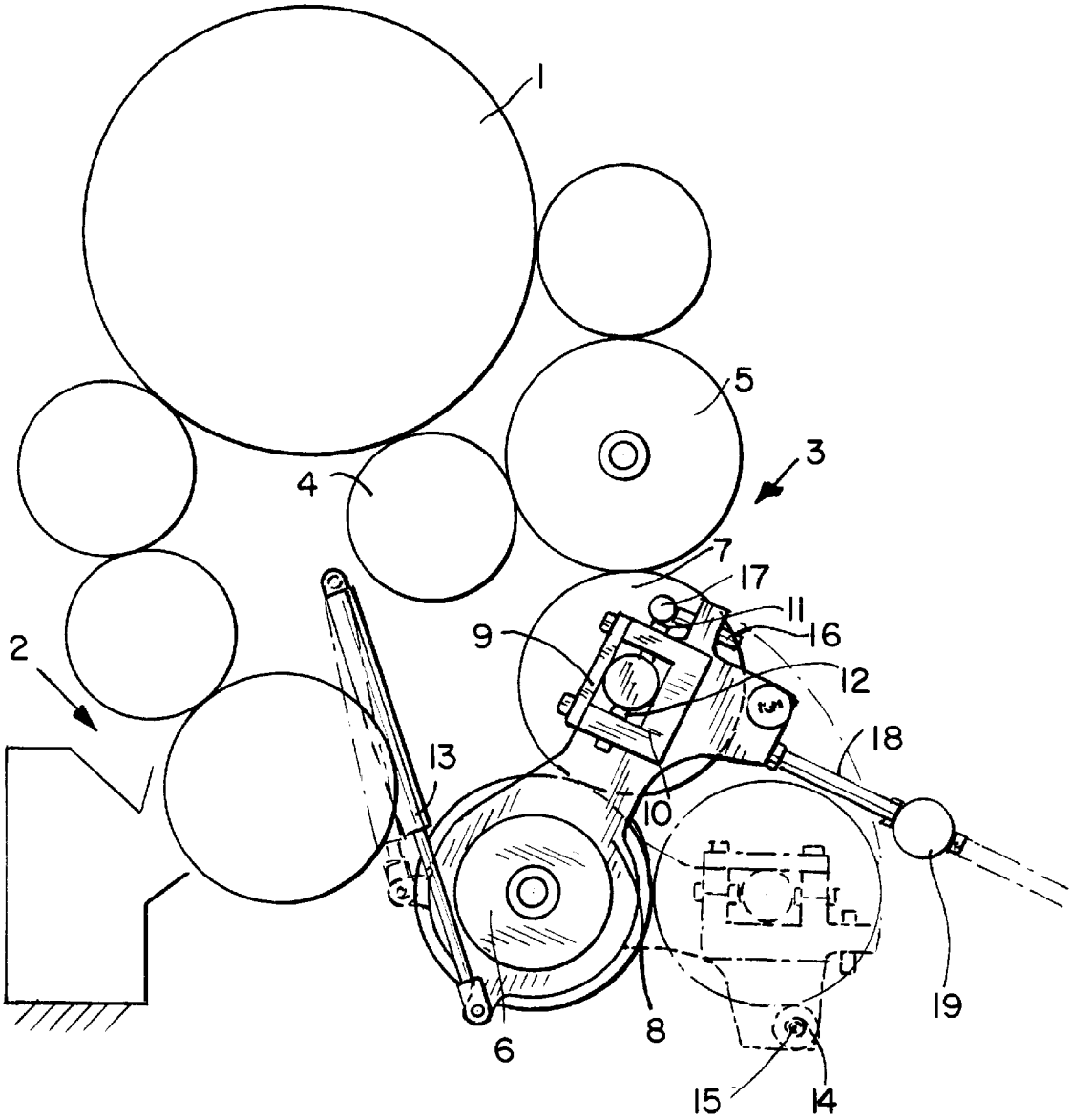
1
5
3
4
7
17
11
16
9
12
2
18
13
10
19
8
6
15
14

INKING UNIT

BACKGROUND OF THE INVENTION

1. Field of the Invention

The invention relates to an inking unit for a rotary printing machine.

2. Description of the Prior Art

German reference DE 34 40 895 A1 discloses an inking unit comprising a plurality of inking rollers in the form of applicator and transfer rollers. The inner inking rollers, which are not accessible from the outside, can be exchanged through a space which can be cleared by a transfer roller between two inking rollers mounted in a fixed manner in the frame. The transfer roller is supported on bearing levers, which are mounted eccentrically with respect to one of the fixed inking rollers, so that the transfer roller can adjust the contact with the inking rollers and can also be released therefrom.

A drawback of this solution is that the inner inking rollers are freely accessible only after the relatively heavy transfer roller has been removed under conditions of limited space.

SUMMARY OF THE INVENTION

Accordingly, it is an object of the present invention to provide an inking unit that permits efficient, user-friendly exchange of the inking rollers.

Pursuant to this object, and others which will become apparent hereafter, one aspect of the present invention resides in an inking unit for a rotary printing machine, which inking unit includes a frame and a plurality of rollers. The plurality of rollers includes two inking rollers fixedly mounted to the frame so as to be spaced from one another, and a transfer roller mounted between the two inking rollers. Bearing levers are pivotably mounted to one of the two inking rollers. The transfer roller is mounted to the bearing levers so as to be pivotable between an operating position between the two inking rollers and a pivoted-out position away from the two inking rollers. A roller holder is provided for adjustably holding the transfer roller on the bearing levers. Additionally, means are provided for compensating for the holding weight of the transfer roller and the bearing levers during pivoting operation.

In another embodiment of the invention the transfer roller is configured so as to be removable from the roller holders in the pivoted-out position while the adjustment of the roller to the inking roller is maintained.

In still another embodiment of the invention means are provided for locking the bearing levers in the pivoted-out position of the transfer roller. The locking means can be formed by a recess in the frame and a locking bolt displaceably mounted in one of the bearing levers so as to be engagable in the recess in the pivoted-out position.

In yet a further embodiment of the invention the weight of the transfer roller and the bearing levers is compensated for by a gas-filled spring having a first end articulated to the bearing levers and a second end mounted on the frame.

The invention permits good accessibility to the inner inking rollers when the transfer roller, which in this position can likewise easily be removed because of the operating freedom provided, is pivoted out. It is also possible to pivot the relatively heavy transfer roller manually with little effort, due to the weight compensation.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWING

The single figure is a diagrammatic representation of a portion of an inking unit, and a dampening unit adjacent to the inking unit, pursuant to the present invention.

DETAILED DESCRIPTION OF THE PREFERRED EMBODIMENTS

As seen in the drawing, a film of dampening agent is provided on a form cylinder 1 for offset printing by a dampening unit 2. A layer of ink is applied on the form cylinder 1 by an inking unit 3. Of the five inking rollers of the inking unit 3 illustrated, an inner inking roller 4, acting as applicator roller, is not accessible from the outside. In order to exchange the inner roller 4, it is possible for the transfer roller 7 arranged at that position to clear a space between two inking rollers 5, 6. The inking rollers 5, 6 are mounted in a fixed manner in a frame or the inking unit. In order to accomplish this spacial clearance the transfer roller 7 is mounted in bearing levers 8 that are arranged to pivot coaxially about one of the fixed inking rollers 6. The bearing levers 8 have U-shaped roller holders 10 which are closed by, in each case, one screwed-on web 9. The roller holders 10 are equipped with adjustment means, that position the transfer roller 7 with respect to the inking roller 6 which is coaxial with the pivot axis. The adjustment means is provided in the form of, in each case, two clampable adjusting screws 11, 12 which are guided in the roller holders 10.

To compensate for the weight of the transfer roller 7 during the pivoting operation, a gas-filled spring device 13 is articulated at one end to the bearing lever 8 and at its other end is fastened pivotably on the frame.

In the pivoted-out position of the transfer roller 7, the bearing lever 8 is secured in place by a locking bolt 15 which is displaceably mounted in the bearing lever 8 and engages in a recess 14 in the frame.

In the pivoted-in position of the transfer roller 7, on the other hand, the bearing lever 8 is supported on one side by a stop 17. The stop 17 is fixed to the frame. An adjusting screw 16 is rotatably mounted in the lever so as to support the lever 8 against the stop 17, and serves to adjust contact between the transfer roller 7 and the other fixed inking roller 5. The other side of the bearing lever 8 is supported against a threaded spindle 18 that acts in the pivoting direction of the bearing lever 8. The spindle 18 is guided in a threaded bore of a holder 19 arranged on the frame outside the pivoting range of the bearing lever 8 so that the spindle 18 can be displaced out of the pivoting range of the bearing lever 8.

In the pivoted-out state of the transfer roller 7, access is provided to the inner inking roller 4, permitting the inner inking roller 4 to be exchanged without previously removing the transfer roller 7. Furthermore, it is also simple to exchange the transfer roller 7 in the position.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

We claim:

1. An inking unit for a rotary printing machine, comprising:

a frame;

a plurality of rollers, the plurality of rollers including two inking rollers fixedly mounted to the frame so as to be spaced from one another to permit removal of yet another roller, and a transfer roller mounted between the two inking rollers;

bearing levers pivotably mounted to a first one of the two inking rollers, the transfer roller being mounted to the bearing levers so as to be pivotable about an axis coaxial with the first of the two inking rollers, between an uppermost operating position between the two inking rollers and a lowermost pivoted-out position away from a second of the two inking rollers so as to permit full access to the space between the two inking rollers;

roller holder means for adjustably holding the transfer roller on the bearing levers; and means for compensating for a holding weight of the transfer roller and the bearing levers during pivoting.

2. An inking unit as defined in claim 1, wherein the transfer roller is configured so as to be removable from the roller holders in the pivoted-out position, while maintaining adjustment with respect to the second inking roller which is coaxial with the transfer roller pivot axis.

3. An inking unit as defined in claim 1, and further comprising means for locking the bearing levers in the pivoted-out position of the transfer roller.

4. An inking unit as defined in claim 3, wherein the locking means includes a recess in the frame and a locking bolt displaceably mounted in one of the bearing levers so as to be engagable in the recess in the pivoted-out position.

5. An inking unit as defined in claim 1, wherein the weight compensating means includes a spring having a first end articulated to the bearing levers and a second end mounted on the frame so that the spring effects the weight compensation for the transfer roller and the bearing levers.

6. An inking unit as defined in claim 1, and further comprising means for holding the bearing levers in the operating position of the transfer roller so that the transfer roller can be adjusted in the pivoting direction.

7. An inking unit as defined in claim 6, wherein the holding means includes a stop fixed to the frame, and an adjusting screw rotatably mounted in one of the bearing levers so as to support the lever against the stop in the operating position, and further comprising blocking means for supporting a side of the one bearing lever opposite the stop, the blocking means being displaced both in the pivoting direction and out of a pivoting range of the one bearing lever.

8. An inking unit as defined in claim 7, wherein the blocking means includes a holder mounted on the frame outside the pivoting range of the bearing lever and having a threaded bore, and a threaded spindle arranged in the threaded bore of the holder so as to contact and act in the pivoting direction of the one bearing lever so that the threaded spindle can be displaced out of the pivoting range of the one bearing lever.

9. An inking unit as defined in claim 5, wherein the spring is a gas spring.

* * * * *